United States Patent [19]

Merkli

[11] Patent Number: 4,927,129

[45] Date of Patent: May 22, 1990

[54] APPARATUS FOR STORING PARTIALLY OVERLAPPING PAPER SHEETS

[75] Inventor: Peter Merkli, Oftringen, Switzerland

[73] Assignee: Grapha-Holding AG, Hergiswil, Switzerland

[21] Appl. No.: 272,119

[22] Filed: Nov. 16, 1988

[30] Foreign Application Priority Data

Nov. 19, 1987 [CH] Switzerland ..... 04503/87

[51] Int. Cl.[5] ..... B65H 39/08; B65B 63/04

[52] U.S. Cl. ..... 270/60; 242/59

[58] Field of Search ..... 270/54, 60; 242/59, 242/68.5; 53/118, 430; 271/315, 275

[56] References Cited

U.S. PATENT DOCUMENTS

| | | | |
|---|---|---|---|
| 4,523,751 | 6/1985 | Merkli | 270/60 |
| 4,768,768 | 9/1988 | Reist | 270/60 |
| 4,832,273 | 5/1989 | Honegger | 242/59 |

FOREIGN PATENT DOCUMENTS

| | | |
|---|---|---|
| 135080 | 7/1984 | European Pat. Off. . |
| 2544135 | 4/1977 | Fed. Rep. of Germany . |
| 3221153 | 2/1983 | Fed. Rep. of Germany . |
| 3231427 | 3/1983 | Fed. Rep. of Germany . |

*Primary Examiner*—Robert E. Garrett
*Assistant Examiner*—Therese M. Newholm
*Attorney, Agent, or Firm*—Peter K. Kontler

[57] ABSTRACT

Partially overlapping sheets of a scalloped stream of sheets are delivered to spaced apart intermediate portions of two elastic bands. One end portion of each band is connected to a second core on which the bands are convoluted over each other so that their convolutions alternate, and the other end portions of the bands are connected to axially spaced apart portions of a first core which gathers a roll of sheets when it is driven in a direction to collect the bands while the sheets of the stream are delivered to the bands between the two cores. The cores are coaxial with each other and are mounted in a frame which further supports several sets of pulleys serving to move the two bands apart in the axial direction of the first core between the first and second cores so that the convolutions of the two bands on the first core overlie axially-spaced apart portions of convoluted paper sheets.

13 Claims, 3 Drawing Sheets

APPARATUS FOR STORING PARTIALLY OVERLAPPING PAPER SHEETS

BACKGROUND OF THE INVENTION

The invention relates to improvements in apparatus for convoluting a stream of sheets on a core, especially for convoluting a scalloped stream of partially overlapping paper sheets which are provided with printed matter. More particularly, the invention relates to improvements in apparatus of the type disclosed in commonly owned U.S. Pat. No. 4,523,751 granted June 18, 1985 to Peter Merkli for "Apparatus for convoluting sheets of paper on a core".

Apparatus of the type to which the present invention pertains are further disclosed in published European patent application No. 135 080 and in published German patent applications Nos. 32 21 153 and 32 31 427. Such apparatus employ a single narrow elastic band, one end portion of which is attached to a first core serving to store a series of sheets and the other end portion of which is affixed to a second core serving for temporary storage of unused portion of the band. A drawback of these conventional apparatus is that the relatively narrow band is not always capable of adequately holding the convolutions of paper sheets on the first core, especially if the sheets are folded and are gathered into a series of partially overlapping stacks, such as signatures or inserts for newspapers. Folding of sheets results in formations which are thicker along the fold lines, and this creates problems when a single narrow band is used to form convolutions which alternate with the convolutions of a stream of partially overlapping folded sheets in order to form a large roll of the type used for temporary storage of insets for weekend editions of newspapers. One of the present known solutions includes reducing the dimensions of the roll so as to ensure that a single narrow band will be capable of properly retaining such sheets. In accordance with another known proposal (disclosed in published German patent application No. 25 44 135), the apparatus is equipped with three cores, namely a first core for collection of a large roll of convoluted paper sheets, a second core for a first elastic band, and a second core for a second elastic band. The two bands are convoluted onto two axially spaced-apart portions of the first core to thus ensure reliable retention of convoluted sheets in optimum positions for temporary storage on the first core. A drawback of such proposal is that the utilization of two elastic bands which are convoluted on discrete cores contributes significantly to space requirements and cost of the apparatus. Thus, it is necessary to provide an additional core as well as room for the additional core, and it is further necessary to provide a discrete drive and a discrete brake for the additional core as well as numerous pulleys for the second band.

OBJECTS OF THE INVENTION

An object of the invention is to provide a novel and improved apparatus which operates with two or more flexible bands but is more compact and less expensive than heretofore known apparatus which employ more than one band.

Another object of the invention is to provide a novel and improved method of guiding several discrete bands on their way toward or away from the core which serves to gather a roll of convoluted paper sheets.

A further object of the invention is to provide an apparatus which operates with several bands but its space requirements do not exceed those of apparatus which employ a single band.

An additional object of the invention is to improve apparatus of the type disclosed in U.S. Pat. No. 4,523,751 and in published German patent application No. 25 44 135.

Still another object of the invention is to provide the apparatus with novel and improved means for storing several elastic bands in a small area and in optimum positions relative to the core for temporary storage of convoluted paper sheets.

SUMMARY OF THE INVENTION

The invention resides in the provision of an apparatus for conveting a succession of sheets into a roll of convoluted sheets. The improved apparatus comprises a frame, first and second cores which are rotatably mounted in the frame, a plurality of elastic bands which are convoluted onto the second core and onto each other and have end portions connected to the first core, and guide means provided in or on the frame to move the bands apart intermediate the first and second cores so that, when the first core is rotated in a direction to collect the bands, the bands are convoluted onto discrete portions of the first core.

The bands include a shorter band and a longer band, and the guide means includes means for stretching the shorter band more than the longer band so that the extent to which the shorter band is stretched more than the longer band exceeds the difference in lengths of the shorter and longer bands. The extent to which the shorter band is stretched more than the longer band is preferably several times the difference in the lengths of the shorter and longer bands. The cores are or can be coaxial.

The guide means can comprise a plurality of pulleys including a first set of pulleys which are rotatable about first axes and a second set of pulleys which are rotatable about second axes. The second axes are inclined relative to the first axes and preferably make with the first axes and angle of 90°.

The bands can have identical widths, and the width of each band can match or approximate the axial length of the second core but is preferably a small fraction of the axial length of the first core.

The guide means and the cores can be installed in the frame at different levels, and the apparatus can comprise means for rotating the first core as well as discrete means for rotating the second core.

The aforementioned discrete portions of the first core can be spaced apart from each other in the axial direction of the first core.

The number of bands can be less than ten, preferably less than five (for example, the second core can carry a roll of two convoluted bands).

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF PREFERRED EMBODIMENTS

Figure 1:
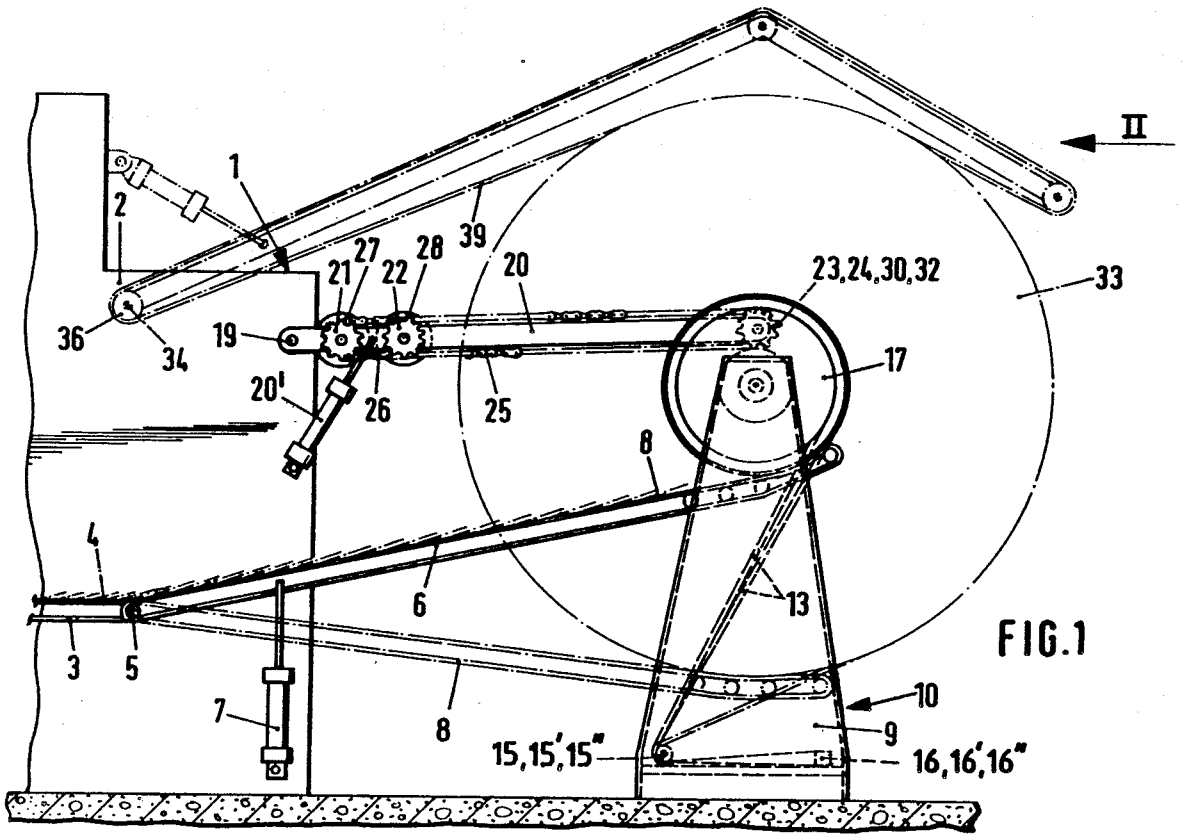
FIG. 1 is a side elevational view of an apparatus which embodies the invention.

Referring to FIG. 1, there is shown a junction 1 where the improved apparatus is coupled to or placed adjacent a magazine forming part of a newspaper printing plant. The magazine comprises a pair of upright cheeks 2 flanking an endless belt conveyor 3 which delivers a scalloped stream of partially overlapping sheets 4 in a direction toward the upper reach of a second endless belt conveyor 8. The direction of movement of the conveyor 8 can be reversed, i.e., this conveyor can serve to deliver sheets 4 from a roll 33 to a newspaper stuffing machine (not shown) where the sheets are inserted into partially assembled newspapers, e.g., into bulky weekend editions of newspapers. The conveyor 3 is also preferably arranged to advance sheets 4 in a direction toward as well as away from the conveyor 8.

The pulley for the right-hand end of the conveyor 3 is mounted on a horizontal shaft 5 which is secured to and extends between the cheeks 2 of the magazine and further serves as a pivot for the left-hand end portion of an elongated rocker 6. This rocker is a one-armed lever which supports the conveyor 8 and has a free end portion movable toward and away from a horizontal shaft 11 (FIG. 2) for a core 17 which is surrounded by the roll 33 of convoluted sheets 4. The conveyors 3 and 8 are driven at the same speed in a manner not forming part of the present invention. It can be said that the upper reach of the conveyor 8 constitutes a pivotable extension of the upper reach of the conveyor 3, and such pivotable extension is tangential to the outermost convolution of sheets 4 which form part of the roll 33 on the core 17.

Figure 2:
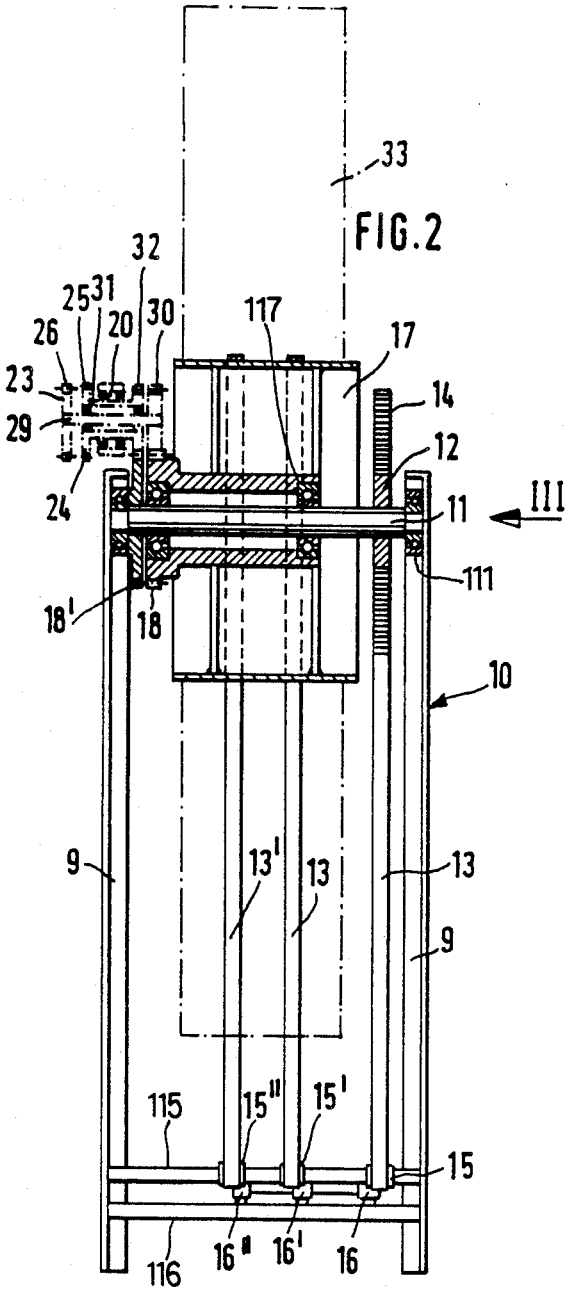
FIG. 2 is an enlarged view of the apparatus as seen in the direction of arrow II in FIG. 1.

The improved apparatus comprises a frame 10 having two spaced-apart upright sidewalls 9 the upper end portions of which support the ends of the shaft 11 for the core 17 and for a second core 12. The core 12 is rigid with the shaft 11, and the latter is rotatable relative to the core 17. In accordance with a feature of the invention, the core 12 is connected with first end portions of two relatively narrow elastic bands 13 and 13′ which are convoluted onto the core 12 and onto each other so that the convolutions of the band 13 alternate with those of the band 13′ (see FIG. 3). The roll which is formed by convoluted portions of the bands 13 and 13′ is denoted by the character 14. As can be seen in FIG. 2, the axial length of the core 12 need not exceed the width of the bands 13 and 13′. The width of the band 13 preferably matches or approximates that of the band 13′.

In accordance with an additional feature of the invention, the frame 10 supports guide means including a first set of pulleys 15, 15′, 15″ and a second set of pulleys 16, 16′, 16″. The axes of the pulleys 15–15″ are horizontal, and the axes of the pulleys 16–16″ are vertical. Furthermore, the pulley 15″ is coaxial with the pulleys 15, 15′ whereas the axes of the pulleys 16, 16′, 16″ are spaced apart from and parallel with each other. The second end portions of the bands 13, 13′ are connected to discrete portions of the core 17, preferably in such a way that the locus of attachment of the second end portion of the band 13 is spaced apart from the locus of attachment of the second end portion of the band 13′, as seen in the axial direction of the core 17.

Figure 3:
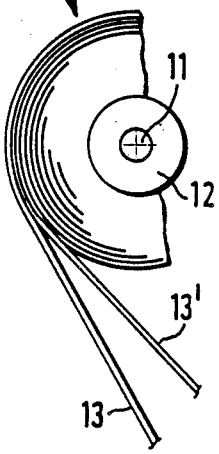
FIG. 3 shows a detail in the apparatus as seen in the direction of arrow III in FIG. 2.
Figure 4:
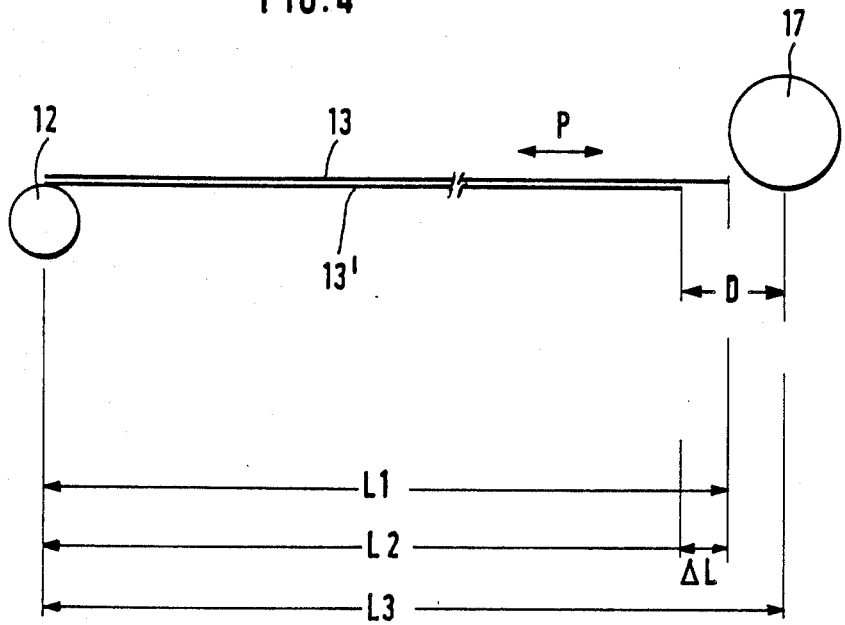
FIG. 4 is a diagrammatic view of the two elastic bands and certain other parts in the apparatus of FIGS. 1 and 2.

FIG. 3 shows that the outermost convolution of the band 13 surrounds the outermost convolution of the band 13′. Thus, the radius of the outermost convolution of the band 13 is greater than the radius of the outermost convolution of the band 13′ and the overall length of the band 13 exceeds the overall length of the band 13′ by $\Delta L$ (see FIG. 4). In order to compensate for such difference in lengths of the bands 13 and 13′, it is necessary to stretch the shorter band 13′ with a force Z greater than the force which is applied for stretching of the longer band 13. Such stretching of the bands 13 and 13′ takes place when the core 17 is driven in a direction to increase the diameter of the roll 33 thereon, i.e., to convolute the intermediate portions of the bands 13, 13′ onto the convolutions which are formed by the stream of sheets 4 advancing with the upper reach of the belt conveyor 8 in a direction to the right, as seen in FIG. 1. The difference D between the extent to which the shorter band 13′ is stretched and the extent of stretching the longer band 13 exceeds the difference $\Delta L$ and can be a multiple of $\Delta L$. FIG. 4 shows that the difference $\Delta L$ equals or approximates half the difference D.

Those portions of the bands 13, 13′ which extend from the roll 14 downwardly toward the guide means including the pulleys 15–15″ and 16–16″ are first trained jointly over the pulley 15, i.e., the belts 13 and 13′ overlie each other between the roll 14 and the pulley 15 as well as on that portion of the peripheral surface of the pulley 15 which is contacted by the belt 13′. The two belts then extend substantially horizontally between the pulleys 15, 16 and are twisted through 90°. As mentioned above, the pulleys 15–15″ are rotatable about a common horizontal axis, and the pulleys 16–16″ are rotatable about parallel vertical axes. The next portions of the belts 13, 13′ (as seen in a direction from the roll 14 toward the core 17) are trained over the pulley 16′ and are separated from each other on their way beyond the pulley 16′. Thus, the longer band 13 extends from the pulley 16′ toward the pulley 15′ whereas the shorter band 13′ extends from the pulley 16′ toward the pulley 16″ and thence toward the pulley 15″. The belt 13 is twisted through 90° between the pulleys 16′, 15′, and the belt 13′ is twisted through 90° between the pulley 16″, 15″. The belt 13 then extends from the pulley 15′ toward the corresponding discrete portion of the core 17 (namely toward the locus where the second end portion of the band 13 is affixed to the core 17), and the belt 13′ extends from the pulley 15″ toward that portion of the core 17 where its second end portion is affixed to 17.

It will be readily appreciated that, if the axial length of the core 17 and the dimensions of the sheets 4 warrant the utilization of three or more elastic bands, the core 12 will be used for storage of three or more overlapping bands and the guide means including the pulleys in the lower portion of the frame 10 will be modified so that the upwardly extending portions of three or more bands will extend toward three or more discrete portions of the core 17 in order to further enhance the reliability of retaining action of the bands upon the convolutions of paper sheets 4 which form part of the roll 33. For example, if the number of elastic bands is increased to three, the horizontal shaft 115 for the pulleys 15–15″ will support a fourth pulley which is located to the left of the pulley 15″ (as seen in FIG. 2), and the horizontal carrier 116 of vertical shafts for the pulleys 16–16″ will support a fourth vertical shaft for a pulley which is located to the left of the pulley 16″ and serves to direct the third band toward the fourth pulley on the shaft 115.

The core 17 is rotatable on antifriction bearings 117 which surround the shaft 11. The end portions of this shaft are mounted in antifriction bearings 111 which are installed in the sidewalls 9 of the frame 10 at a level above the pulleys 15–15″ and 16–16″. The core 12 is rigidly secured to the shaft 11 between the core 17 and one of the sidewalls 9.

The means for rotating the core 17 includes a gear 18 which is rigid with this core and is disposed between the core 17 and that sidewall 9 which is remote from the core 12. The means for rotating the core 12 includes a second gear 18′ which is affixed to the shaft 11 and is adjacent the gear 18. The apparatus further comprises means for driving the gear 18 independently of the gear 18′. As shown in FIG. 1, the cheeks 2 of the magazine for sheets 4 support the end portions of a horizontal shaft 19 serving as a fulcrum for an elongated lever 20. The lever 20 is pivotable in clockwise and counterclockwise directions by a fluid-operated motor 20′ which is articulately connected to one of the cheeks 2. An intermediate portion of the lever 20 carries two sprocket wheels 21 and 22 which are installed at different distances from the shaft 19. The free end portion of the lever 20 carries two additional sprocket wheels 23 and 24 which are rotatable about a common horizontal axis. A first endless chain 25 is trained over the sprocket wheels 21, 24 and a second endless chain 26 is trained over the sprocket wheels 22, 23. The sprocket wheel 21 can be driven by a first combined torque transmitting and braking motor 27, and the sprocket wheel 22 can be driven by a discrete second combined torque transmitting and braking motor 28.

The sprocket wheel 23 at the free end of the lever 20 is rigidly connected with a horizontal shaft 29 which is further rigidly connected with a gear 30 movable into and out of mesh with the gear 18 (see FIG. 2) in response to pivoting of the lever 20 about the axis of the shaft 19. The shaft 29 is surrounded by a hollow shaft 31 which is rigidly connected with the sprocket wheel 24 and with a gear 32 movable into and out of mesh with the gear 18′ in response to pivoting of the lever 20 about the axis of the shaft 19. Thus, by the simple expedient of actuating the motor 20′ in a direction to pivot the lever 20 counterclockwise, the gears 30, 32 can be lifted above and away from the respective gears 18, 18′ to thus disconnect the motor 27 from the core 12 as well as to disconnect the motor 28 from the core 17. The speed at which the core 12 is rotated clockwise or counterclockwise need not match the speed at which the gear 18 rotates the core 17 in a clockwise or counterclockwise direction.

The motors 27 and 28 are dimensioned in such a way that the extent to which the shorter band 13′ is stretched exceeds the extent of stretching of the longer band 13. The difference between stretching the bands 13 and 13′ should exceed the difference $\Delta L$. As mentioned above, D is preferably a multiple of $\Delta L$. FIG. 4 shows the bands 13 and 13′ in unwound condition between the cores 12 and 17. The exact manner in which the end portions of the bands 13 and 13′ are attached to the cores 12 and 17 forms no part of the invention. The right-hand end portions of the bands 13, 13′ are shown detached from the core 17 to show that, in unstretched condition of the two bands, the length of the band 13 exceeds the length of the band 13′ by $\Delta L$. Otherwise stated, the length L1 of the unstretched band 13 exceeds the length L2 of the unstretched band 13′ by $\Delta L$. The minimum stretch of the band 13′ (in order to increase its length L2 to that which matches or exceeds L1) equals $\Delta L$. When the bands 13 and 13′ are acted upon the force P which increases the length of the band 13 from L1 to L3, the band 13 is lengthened by $D - \Delta L$. The force P acting upon the band 13′ is then selected in such a way that the length L2 of the band 13′ is increased to L3, i.e., by the value D.

The operation of the improved apparatus is as follows:

The upper end portions of the bands 13, 13′ are separably or more less permanently affixed to the core 17, and the frame 10 is placed adjacent the cheeks 2 of the magazine. The fluid-operated motor 7 is actuated so as to move the lever 6 to the solid-line position of FIG. 1 in which the upper reach of the endless belt conveyor 8 is tangential to the core 17. The motor 20′ is operated to pivot the lever 20 to the position of FIG. 1 in which the gears 30, 32 respectively mesh with the gears 18 and 18′. The motor for the belt conveyors 3 and 8 is started so that the conveyors begin to advance the scalloped stream of sheets 4 against the bands 13 and 13′ between the pulleys 15′, 15″ and the core 17. The gear 18 is rotated to drive the core 17 in a counterclockwise direction, as seen in FIG. 1, and the upwardly advancing straight portions of the bands 13, 13′ move the stream of sheets 4 toward the periphery of the core 17 where the sheets form convolutions which alternate with the convolutions of the bands 13 and 13′. The speed of the conveyors 3, 8 matches that of the bands 13, 13′. The growing roll 33 on the core 17 causes the lever 6 to pivot in a clockwise direction, and such pivoting is opposed by the motor 7 which can be operated by compressed air or by another compressible fluid. The conveyor 8 can be assembled of several narrow belts which alternate with the bands 13, 13′ so that the conveyor 8 can cross the band portions between the growing core 33 and the pulleys 15′, 15″.

The speed of the motor 28 is regulated as a function of the speed of the belt conveyors 3, 8 so that the motor 28 drives the core 17 at a constant speed. The rotating core 17 draws the bands 13, 13′ off the core 12 whereby the upwardly moving band portions between the pulleys 15′, 15″ and the growing roll 33 divert successive sheets 4 upwardly and cause such sheets to form a series of convolutions which alternate with the convolutions of the bands 13, 13′. The extent to which the right-hand end portion of the lever 6 projects beyond the paths of the bands 13, 13′ between the growing roll 33 and the pulleys 15′, 15″ remains substantially unchanged. When the roll 33 is fully grown, the lever 6 assumes the phantom-line position of FIG. 1 and the motor 28 is arrested, together with the motor for the conveyors 3, 8.

The motor 27 acts as a brake while the motor 28 drives the core 17 in a counterclockwise direction. This ensures that the bands 13 and 13′ are properly tensioned between the rolls 14 and 33 when the improved apparatus is in use to accumulate a growing roll 33 of alternating convolutions of paper sheets 4 and convoluted portions of bands 13, 13'.

The motors 7 and 20' are actuated to move the levers 6 and 20 away from the fully grown roll 33 so that the frame 10 can be pushed or pulled away from the magazine to provide room for the frame of another apparatus. For example, the frame 10 with a fully grown roll 33 can be put into temporary storage.

If an apparatus which carries a fully grown roll is to be relieved of the supply of convoluted sheets 4, the frame 10 is returned to the position of FIG. 1, the motors 7 and 20' are actuated to move the levers 6 and 20 to the phantom-line positions of FIG. 1, the motor 27 is started to drive the core 12 in a direction to collect the bands 13, 13' and the conveyor 8 is driven in a direction to accept successive increments of the scalloped stream of sheets 4 from the roll 33. Such increments of the scalloped stream are delivered onto the upper reach of the conveyor 3. The motor 28 then acts as a brake to ensure that the bands 13, 13' are properly tensioned between the roll 33 and the pulleys 15', 15''.

Once the supply of sheets 4 which form part of the roll 33 is depleted, the apparatus is ready to accept a fresh supply of sheets 4 without any alterations or changes of setup except that the direction of movement of the conveyors 3, 8 is reversed, that the motor 28 is used to drive the core 17 in a direction to collect the sheets 4 and the bands 13, 13', and that the motor 27 acts as a brake for the core 12.

FIG. 1 further shows certain parts of a different embodiment of drive means which can rotate the core 17 and the roll 33. Such drive means comprises an endless belt conveyor 39 which is trained over pulleys 36 and is mounted on an inverted V-shaped carriage pivotably mounted on a horizontal shaft 34. Reference may be had to the aforementioned commonly owned U.S. Pat. No. 4,523,751.

An important advantage of the improved apparatus is that it can properly retain convoluted sheets 4 of any practical size and regardless of whether the sheets 4 are individual sheets, signatures or other accumulations of folded or unfolded portions of comminuted paper webs or the like. In addition, conversion from gathering a roll 33 to paying out the sheets 4 can be completed within a very short interval of time.

The apparatus of FIGS. 1 and 2 can be modified in a number of ways without departing from the spirit of the invention. For example, it is possible to omit the motor 28, the sprocket wheels 22, 23 and the chain 26 if the apparatus employs the aforementioned endless conveyor 39. It is even possible to rotate the core 17 and the roll 33 by the upper reach of the conveyor 8.

If the apparatus which is shown in FIG. 1 serves exclusively as a means for gathering rolls 33 of paper sheets or the like, the motor 27 can be replaced with a simple brake which need not transmit driving torque. On the other hand, if the apparatus is to be used exclusively as a means for unwinding convoluted paper sheets or the like, the motor 28 can be replaced with a simple brake which need not transmit driving torque. The apparatus will serve exclusively as a means for collecting sheets if successively formed fully grown rolls 33 are lifted out of the frame 10 together with their cores 17 and are replaced with empty cores, and the apparatus will be used exclusively as a means for paying out sheets if an empty core 17 is replaced with a core 17 carrying a fully grown roll 33 thereon. An empty core 17 must be disconnected from the respective end portions of the bands 13, 13' prior to being lifted out of the frame 10, and the bands 13, 13' must be disconnected from the core 12 (or such core must be removed with the bands) when a fully grown roll 33 is to be lifted out of the frame 10.

FIG. 4 shows that the core 12 need not be coaxial with the core 17.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for converting a succession of sheets into a roll of convoluted sheets, comprising a frame; first and second cores rotatably mounted in said frame; a plurality of elastic bands convoluted onto said second core and onto each other and having end portions connected to said first core, said bands including a shorter band and a longer band; and guide means provided in said frame for moving the bands apart intermediate said cores so that when the first core is rotated to collect said bands, the bands are convoluted onto discrete portions of said first core, said guide means including means for stretching said shorter band to a greater first extent and for stretching the longer band to a lesser second extent so that the difference in the stretching of said shorter and longer bands exceeds the difference in lengths of said shorter and longer bands.

2. The apparatus of claim 1, wherein said difference in stretching is several times said difference in lengths.

3. The apparatus of claim 1, wherein said cores are coaxial.

4. The apparatus of claim 1, wherein said guide means comprises a plurality of pulleys.

5. The apparatus of claim 4, wherein said pulleys include a first set of pulleys rotatable about first axes and a second set of pulleys rotatable about second axes which are inclined relative to said first axes.

6. The apparatus of claim 5, wherein said second axes are normal to said first axes.

7. The apparatus of claim 1, wherein said bands have identical widths.

8. The apparatus of claim 1, wherein said guide means and said cores are disposed at different levels.

9. The apparatus of claim 1, further comprising means for rotating said first core, and means for rotating said second core.

10. The apparatus of claim 1, wherein the width of said bands is a small fraction of the axial length of said first core.

11. The apparatus of claim 1, wherein the axial length of said second core equals or approximates the width of said bands.

12. The apparatus of claim 1, wherein said discrete portions of said first core are spaced apart from each other in the axial direction of said first core.

13. The apparatus of claim 10, wherein the number of bands is less than five.

* * * * *